US005660468A

United States Patent [19]

Okajima et al.

[11] Patent Number: 5,660,468

[45] Date of Patent: Aug. 26, 1997

[54] AGITATING BLADE FOR A MAIN TANK OF GLUE PREPARING EQUIPMENT

[75] Inventors: Ichiro Okajima; Sukeharu Imazu; Tohru Horimoto, all of Hiroshima, Japan

[73] Assignee: Mihara Ryoju Engineering Co., Ltd., Mihara, Japan

[21] Appl. No.: 538,221

[22] Filed: Oct. 3, 1995

[30] Foreign Application Priority Data

Oct. 12, 1994 [JP] Japan ..... 6-245957

[51] Int. Cl.[6] ..... B01F 7/02; B01F 7/16

[52] U.S. Cl. ..... 366/306; 366/286; 366/307; 366/314; 366/601; 366/608

[58] Field of Search ..... 366/64, 65, 262–265, 366/285, 286, 302, 303, 304, 306, 307, 314, 315, 316, 317, 608, 601

[56] References Cited

U.S. PATENT DOCUMENTS

| | | | |
|---|---|---|---|
| 42,481 | 4/1864 | Hewett | 366/307 X |
| 48,278 | 6/1865 | Holloway | 366/306 X |
| 74,420 | 2/1868 | Porter et al. | 366/307 |
| 1,255,944 | 2/1918 | Stevens | 366/302 X |
| 1,268,601 | 6/1918 | Nielsen | 366/608 X |
| 1,268,602 | 6/1918 | Nielsen | 366/608 X |
| 2,212,261 | 8/1940 | Brothman | 366/264 |
| 3,630,495 | 12/1971 | Carroll | 366/343 |
| 3,973,759 | 8/1976 | Mizrahi et al. | 366/264 |
| 4,388,864 | 6/1983 | Warner | 366/601 X |
| 4,506,989 | 3/1985 | Reh | 366/286 X |
| 4,541,724 | 9/1985 | Cornelissen | 366/302 X |

FOREIGN PATENT DOCUMENTS

| | | | |
|---|---|---|---|
| 1212943 | 3/1966 | Germany | 366/314 |
| 101715 | 6/1962 | Netherlands | 366/264 |

*Primary Examiner*—Charles E. Cooley
*Attorney, Agent, or Firm*—Foley & Lardner

[57] ABSTRACT

A main tank for preparation of glue having agitation effect and shearing effect far larger than in the conventional tank is fitted with an agitator having multiple blades on a shaft supported to allow rotation on the bottom of a tank. A disc is provided having numerous teeth in the radial direction, with a gap δ from the lower surface of the agitating blade. One or more baffles having a triangular cross-section are provided on the inner side surface of the tank and one or more baffles of the same construction are on the bottom. The lower surface of the agitating blade is of a flat shape, and can have teeth at an angle crossing the teeth of the disc. The gap δ between the agitating blade and the disc is adjustable.

13 Claims, 9 Drawing Sheets

AGITATING BLADE FOR A MAIN TANK OF GLUE PREPARING EQUIPMENT

BACKGROUND OF THE INVENTION

The present invention relates to improved glue preparing equipment and, more particularly to a main tank suitable for use in equipment for manufacturing starchy glue as an adhesive for corrugated cardboard.

As is commonly known, two-sided corrugated cardboard is manufactured by spreading glue over the surfaces of corrugations of a corrugated core sheet of paper, and putting the core sheet between two liner sheets of paper which are glued to the core for forming the product. This glue is manufactured from corn starch or potato starch, for example. Typical manufacturing methods include: (1) the Stein-Hall method, (2) the no-carrier method, and (3) the Mino-Carr method.

Three conventional glue preparing procedures are described as follows. Method (1) comprises, for example, the steps of filling a main tank with 1,000 liters of 50° C. hot water, charging 100 kg of starch while stirring the mixture, then adding 45 kg of caustic soda of a concentration of 33.3%, agitating the resultant mixture for about 20 minutes until the formation of glue, which is known as carrier. After diluting the carrier with 1,300 liters of water, 500 kg of main starch are added, and borax is added after the lapse of a few minutes. Agitation of the mixture for another 20 minutes completes glue preparation.

Method (2) comprises, for example, the steps of charging 600 kg of starch into 1,900 liters of 35° C. hot water, agitating the resultant mixture, then adding 454 kg of 4.2% caustic soda, adding borax after agitation for 20 minutes, and further agitating for another 20 minutes to complete glue preparation.

Method (3), which comes between methods (1) and (2), comprises, for example, the steps of first charging 300 kg of starch into 2,300 liter of 35° C. hot water, adding 54 kg of 31.5% caustic soda, stirring the mixture for 20 minutes, then adding 300 kg of secondary starch, agitating the mixture for 20 minutes, and adding borax while agitating, to complete glue preparation.

Glue preparation based on these conventional methods is basically accomplished in a main tank as shown in FIG. 15. The main tank is composed of an agitator comprising a cylindrical tank body 17, agitating blades 18 and 19, a shaft 20 and a motor 21. Water (hot water) W, starch D, caustic soda N, and boric acid B are charged from above into the tank 17. Glue is prepared by methods (1) to (3) as described above using this type of conventional tank. When it is necessary to heat the mixture during the steps of glue preparation, steam S is injected through the wall of the tank 17. Upon completion of glue preparation, the liquid is transferred through a valve 22 by a pump 23 into a storage tank T.

The agitating blades 18 and 19 are rotated at a relatively high speed. The agitating blade 18 is a disc having saw teeth and has the function of agitating the starch solution as well as imparting a shear to accelerate dispersion of the starch and control the viscosity thereof. The agitating blade 19 has the function of only agitating the mixture, and may be omitted.

The procedures shown in FIGS. 16 and 17 are used for method (1) above. The procedure of FIG. 16 comprises the steps of, after charging main starch into the tank 17, continuously extracting the starchy solution from the bottom of the tank 17 through a valve 24, sending the extracted solution to a high-speed shear comprising a tank 25, an agitating blade 26 and a motor 27 by means of a pump 23, and circulating the solution further through a valve 28 to the tank 17. This high-speed shear is more intense than that of the agitating blade 18.

The procedure shown in FIG. 17 comprises the steps of, after preparing carrier in a primary tank which is composed of a tank 29, an agitating blade 30 and a motor 31, feeding the prepared carrier into a tank 33, called the secondary tank and previously filled with diluting water, and charging secondary starch into the mixture while agitating the same with an agitator, which is composed of an agitating blade 34, a shaft 35 and a motor 36.

Then, in the procedure shown in FIG. 18, a high-speed shear which is composed of a blade 38, a shaft 39 and a motor 40, is additionally provided in the secondary tank shown in FIG. 17. This procedure is used for method (2) above, and comprises the steps of charging hot water and starch into a tank 33, adding caustic soda while agitating the mixture with a low-speed agitator which is composed of an agitating blade 34, a shaft 35, and motor 36, and preparing glue by further operating the high-speed shear described above. In FIG. 18, the abbreviation Dr represents a path to the drain pit.

Glue for corrugated cardboard is basically prepared by adding caustic soda while agitating starch dispersed in hot water (hereinafter referred to as "starchy slurry"), but the properties of the glue including adhesiveness and viscosity stability are not satisfactory unless a sufficient shear is imparted. It is necessary to rotate the agitator at a high speed for this purpose. However, because each agitator is suspended from above as shown in FIGS. 15 to 17, high-speed rotation requires using an agitating blade of small diameter due to limitations in vibration and strength. This reduces the pumping volume of the blade, thus resulting in a reduction of the amount of circulated starchy slurry, and also a reduction of the number of saw teeth of the agitating blade shown in FIGS. 15 and 16.

The resultant drawbacks include failure to disperse the starch and to effectively impart shear to the starchy slurry. It is well known that the installation of baffles on the tank inner wall permits more effective agitation. In the agitators shown in FIGS. 15 and 16, however, the low agitating force leads to inconvenient adhesion of undispersed starch onto the baffles.

Particularly, method (1), in which the carrier starchy slurry has a high consistency even after dilution, has the inconvenience that part of the main starch remains undispersed. To avoid this, milling and shearing are conducted with a high-speed shear shown in FIG. 16, or carrier is prepared in a small-volume primary tank as shown in FIG. 17, and the glue is prepared by increasing the degree of dilution in a secondary tank. In both cases, two tanks are required. The method shown in FIG. 16 has a drawback in that the transfer of liquid to a storage tank after completion of glue preparation causes part of the glue to remain in the piping 37, and this residue is mixed with starchy slurry in the next run, thus destabilizing the quality of glue.

When adding caustic soda to starchy slurry and continuing agitation, starch particles swell and are partially converted into glue under the effect of shear. This reaction depends upon the revolutions of the agitator of the main tank. In the conventional method, in which the agitator operates at a constant speed, it is impossible to adjust the glue properties unless the raw material conditions are changed.

Furthermore, since the blade structure of the agitator is fixed, it is impossible to adjust the glue properties by altering the set conditions of the blade, and in addition, the pumping volume is small. This means that the suction volume of the agitator is small. This results in defects such as poor suction of light undispersed matters accumulating at the tank center and low dispersibility of the starchy slurry. The practices shown in FIGS. 16 to 18 using two agitators have the problem of increased mechanical loss of the drive section. In the conventional methods, as described above, shearing accomplished when the slurry is in a free state causes low efficiency, and the small number of teeth and the small tooth length require high-speed rotation, resulting in problems such as large power consumption.

An object of the present invention is to solve the above-mentioned problems in the conventional methods, and to provide a main tank for use with glue preparing equipment which delivers remarkable agitating and shearing effects and can cope with higher speeds by providing a larger-diameter agitating blade and baffles.

SUMMARY OF THE INVENTION

To achieve the above-mentioned objectives and solve the problems, the present invention provides a main tank for use with glue preparing equipment, wherein an agitator having multiple blades and an agitating unit which comprises a disc provided with numerous radial projecting teeth on a surface thereof facing and spaced apart from the lower surface of the agitator, are provided on the bottom surface or the side surface of the tank. A feature of the present invention is the agitator fixed to a shaft supported to allow rotation on the tank bottom or side wall and the disc is attached to the tank bottom or side wall. In another embodiment, the surface of the agitator facing the disc is formed into a flat shape. Still another embodiment relates to a device wherein teeth are formed on the surface of the agitator facing the disc at an angle crossing the teeth of the disc.

The present invention further provides another means to solve the above-mentioned problems, wherein the distance between the lower surface or the side surface of the agitator and the tooth surface of the disc is adjustable, wherein a bell mouth is fixed on the upper surface of the agitator, or wherein the viscosity of produced glue is arbitrarily controlled by driving the agitator at a constant speed or at a variable speed, and at the same time, associating the same with an inline viscosity sensor provided within the tank, or varying the speed of the agitator during operation to an arbitrary value by means of manual viscosity measurement.

The present invention further provides another means to solve the above-mentioned problems, wherein glue is prepared with a value of at least 250 ($-/sec \cdot m^2$) calculated by the equation of ((number of teeth of the disc)×(tooth length (mm))×(number of blades)×(revolutions (rps)))/(slurry volume ($m^3$)) and at an outermost circumferential blade speed of at least 8 m/sec, wherein one or more baffles each having a triangular cross-section are provided on the bottom surface and the side surface of the tank, or wherein the triangular baffles have a vertical angle of 45° in the upstream direction of the flow and at least 75° in the downstream direction.

By providing agitating blades on the tank bottom or side wall, according to the present invention, it is possible to use agitating blades of a larger diameter, and an agitating force far stronger than the conventional one can be produced. By forming the cross-section of the baffle into a substantially triangular shape and reducing the angle in the upstream direction and that in the downstream direction to prevent stagnation of the flow at points a, b, c and d near the connecting portion between the baffles and the tank, it is possible to install baffles, further improve the agitating effect, and prepare glue of a high concentration slurry. The agitating unit based on a combination of the agitating blades and the toothed disc allows a shearing effect stronger than the conventional one to be exerted on the slurry, and the viscosity of the product glue to be reduced.

This shearing effect depends upon the inverse number of the value determined by the formula: (number of disc teeth)×(number of blades of the agitating unit)×(revolutions) ×tooth length×(distance between blade and disc). Because there is no particular risk of breakage, it is possible to increase the number of teeth, and thus to improve the shearing effect even at low revolutions.

Furthermore, by attaching a bell mouth, a vortex is formed at the tank center, and it is thus possible to increase the suction force and selectively suction off light-weight suspended solids. By varying the revolutions of the agitating blade, the curve of the relationship between the viscosity and the agitation time changes: the viscosity is higher as the revolutions decrease. By changing the revolutions of the motor through interlocking with the inline viscometer of the main tank, it is possible to freely change the viscosity-agitation time curve.

By changing the distance between the agitating unit and the disc, on the other hand, the inclination of the viscosity-agitation time curve varies even at constant revolutions of the agitating blades: a larger distance leads to a slower inclination.

PREFERRED EMBODIMENTS

Figure 1:
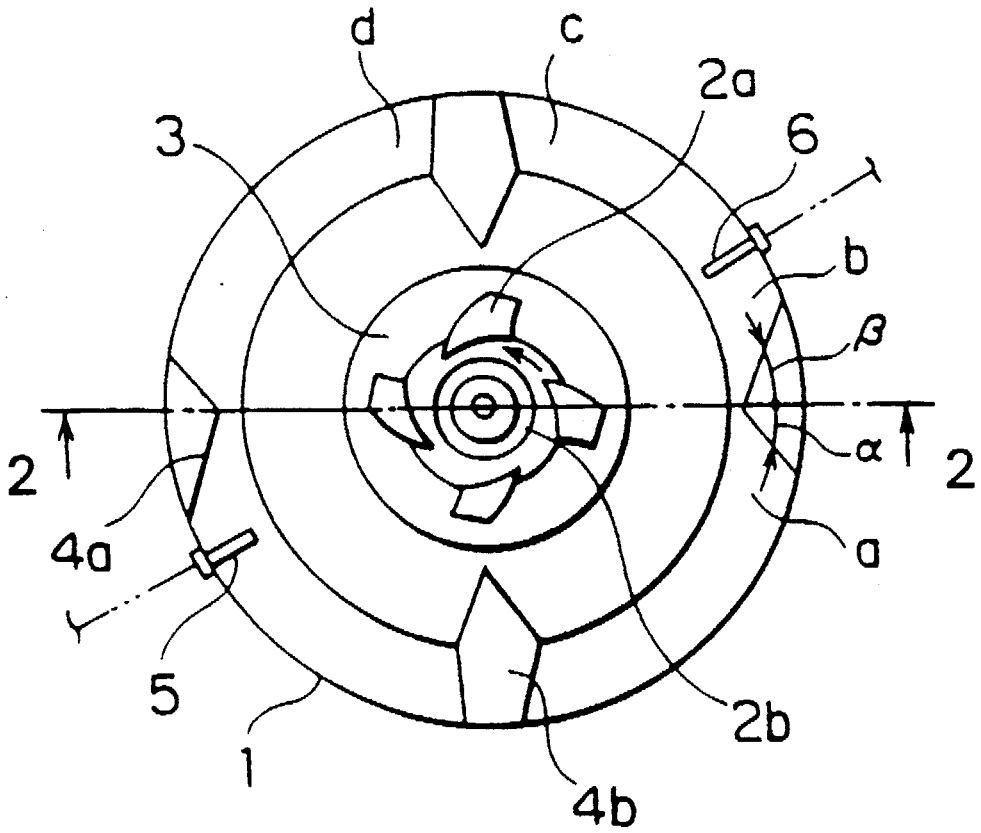
FIG. 1 shows a plan view of the glue preparing equipment main tank of a first embodiment of the present invention.

Now, the present invention is described by means of embodiments shown in the drawings. FIGS. 1 to 4 illustrate embodiments of the present invention. First, as shown in the first embodiment shown in FIGS. 1 and 2, the main tank comprises a tank 1, having a relatively large diameter, having baffles 4*a* and 4*b* attached to the side wall and bottom surfaces thereof, an agitator comprising a large-diameter agitating blade and a shaft 2*b* which projects from the bottom surface into the tank 1 and has the agitating blade 2*a* fixed thereto, and an agitating unit, facing the agitator, composed of a disc 3 attached to the bottom surface of the tank 1. The shaft 2*b* is supported on the bottom of the tank 1 as shown in FIG. 2. The shaft 2*b* is therefore short in length and can well withstand the drive of the large-diameter agitating blade 2*a*. The disc 3 has a plurality of radial teeth 7 projecting on the surface thereof facing the agitating blade 2*a*. The lower surface of the agitating blade 2*a* is flat, or a plurality of teeth are cut at an angle crossing the teeth 7 of the disc 3.

The baffles 4*a* and 4*b* have a substantially triangular cross-section with vertical angles $\alpha$ and $\beta$. The angle $\alpha$ in the upstream side of the flow is 45°, and the angle $\beta$ in the downstream side is at least 75°.

Figure 3:
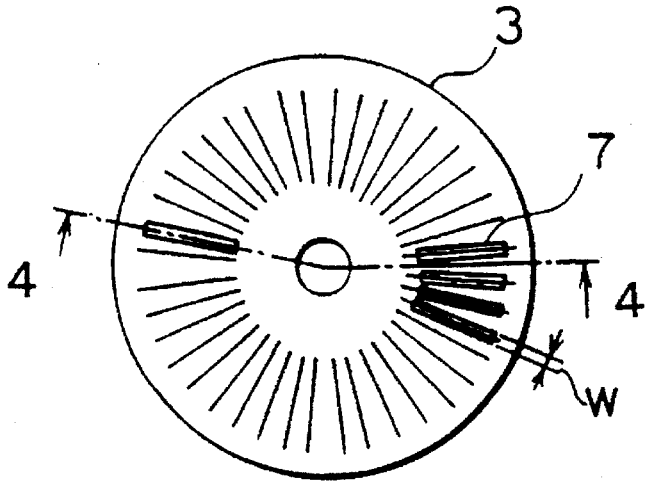
FIG. 3 shows a plan view of the disc shown in FIG. 1.
Figure 4:
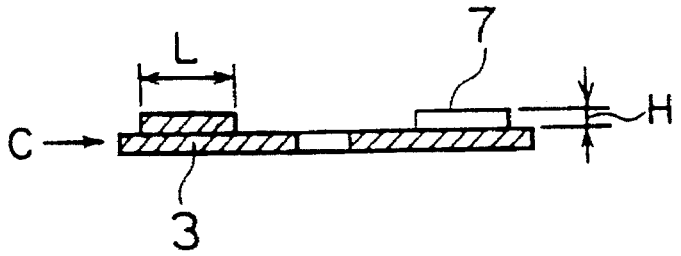
FIG. 4 shows a sectional view of FIG. 3 cut along the line 4—4.
Figure 5:
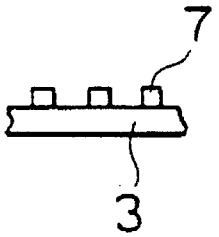
FIG. 5 shows a side view of FIG. 4 as viewed in the direction of arrow C.

As shown in the details of the disc 3 illustrated in FIGS. 3 and 4, the disc 3 has numerous teeth 7 projecting in the radial direction on the surface thereof facing the agitating blade 2*a*. The agitating unit is provided so that the disc 3 and the agitating blade 2*a* face each other by providing a gap $\delta$ between the lower surface of the agitating blade and the teeth 7 of the disc 3. The circumferential speed along the outermost circumference must be at least 8 m/sec. A tooth has a width W ranging from 2 to 10 mm, a height H of 3 to 10 mm, and a length L of at least the length covering the agitating blade 2*a*, and the disc 3 should have at least 20 teeth around the entire circumference.

Figure 6:
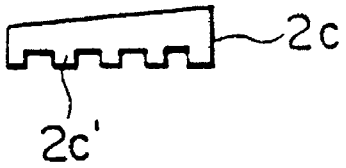
FIG. 6 shows a side view of FIG. 2 as viewed in the direction of arrow D, illustrating an embodiment of an agitating blade different from that shown in FIG. 2.

The agitating blade 2*c* shown in FIG. 6 represents an embodiment different from the agitating blade 2*a* (having a flat lower surface) shown in FIG. 2, and has teeth 2*c*' cut on the blade lower surface. These teeth 2*c*' are cut at an angle crossing the teeth 7 of the disc 3 as described above.

The gap $\delta$ between the lower surface of the blade 2*a* or 2*c* and the upper surfaces of the teeth 7 of the disc 3 is adjusted by moving the disc 3 or the shaft 2*b* in the axial direction within an adjustable range of from 0.1 to 10 mm.

Figure 7:
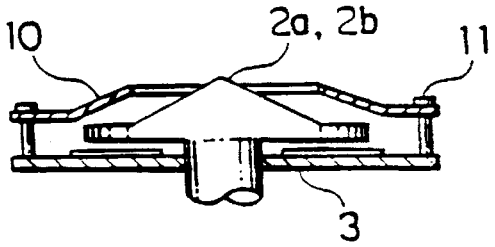
FIG. 7 shows a side sectional view illustrating attachment of a bell mouth of an embodiment of the present invention.
Figure 8:
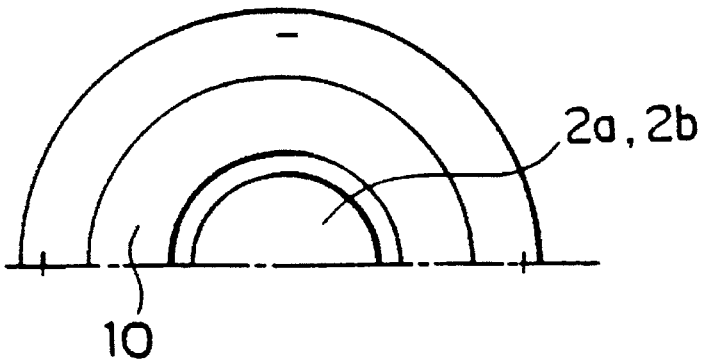
FIG. 8 shows a plan view illustrating only one half that shown in FIG. 7.

FIGS. 7 and 8 illustrate a state in which a bell mouth is attached. The bell mouth 10 is attached to the disc 3 with a bolt 11 so as to cover the agitator. A perforated plate forms the inclination of the bell mouth 10. By changing the aperture ratio from 0% to about 60%, it is possible to adjust the effect of the bell mouth.

Figure 9:
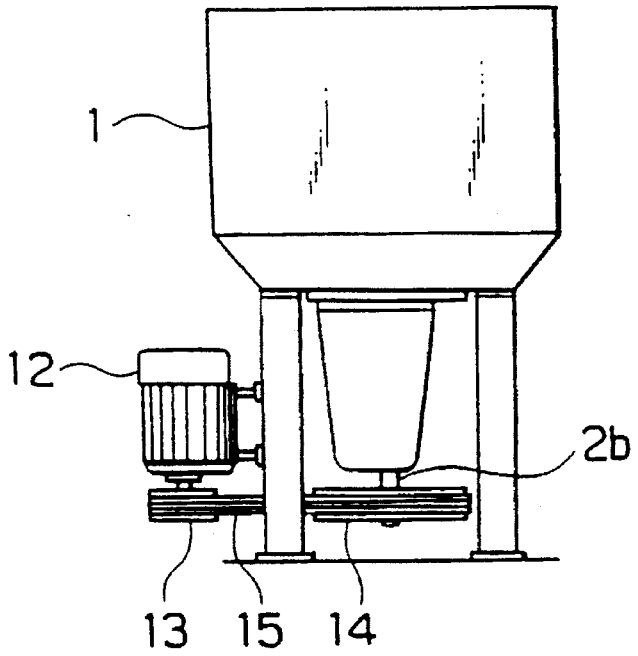
FIG. 9 shows a side view illustrating the driving mechanism of the agitating blade shown in FIG. 2.

FIG. 9 illustrates attachment of a driving motor 12 of the agitator in the tank 1. Pulleys 13 and 14 are attached to the motor 12 and the shaft 2*b* of the agitator, respectively, and the agitator shaft 2*b* is driven by the motor 12. The motor 12 may be made variable-speed with an invertor, for example. Pulleys 13 and 14 may be connected to each other by a suitable belt 15.

Figure 2:
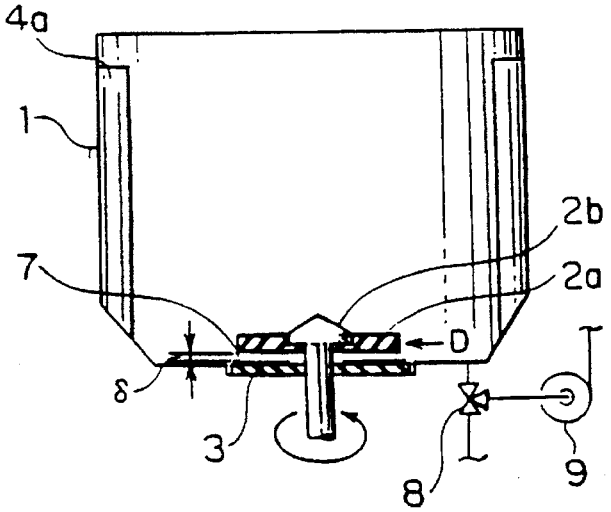
FIG. 2 shows a sectional view of FIG. 1 cut along the line 2—2.

As shown in FIG. 1, a viscosity sensor 5 is attached to the tank 1 for continuous or intermittent transmission of output so as to be interlocked with the revolution control of the motor 12. In FIG. 1, 6 is a temperature sensor.

Figure 11:
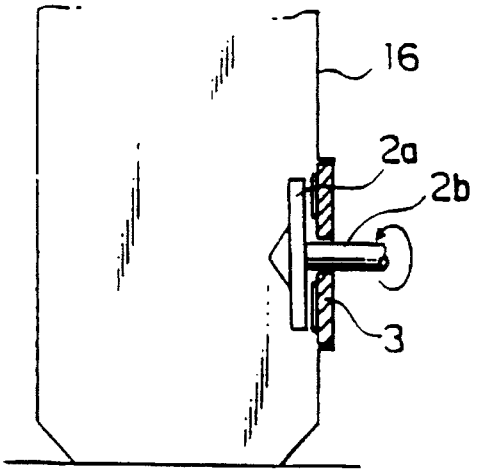
FIG. 11 shows a sectional view of FIG. 10 cut along the line 11—11.
Figure 10:
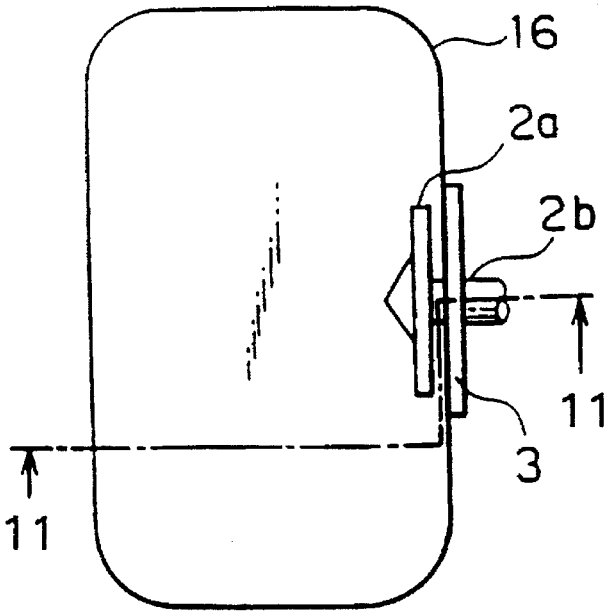
FIG. 10 shows a plan view of the agitator section of the glue preparing equipment main tank of the second embodiment of the present invention.

While the agitator is provided on the bottom of the tank 1 in FIG. 1, the attachment position of the main tank agitator is altered to the side wall surface of the tank 16 in FIGS. 10 and 11. The agitating blade 2*a* and the disc 3 have the same structures as in FIG. 1. The tank 16 has a horizontal section of substantially a rectangular shape, with no baffles.

Now, the detailed description for the preparation of glue using the equipment described in the embodiments of the present invention will be described below.

EXAMPLE 1

When agitation is carried out at a circumferential speed of at least 8 m/sec along the outermost circumference of the agitating blade 2*a* (or 2*c*) in the main tank of FIG. 1, glue can be prepared by any of (1) the Stein-Hall method, (2) the no-carrier method, and (3) the Mino-Carr method, which are typical methods of manufacturing starchy glue as an adhesive for corrugated cardboard.

First, the case of glue preparation with triple-volume water by the Stein-Hall method will be described.

The basic mechanical structure is as shown in FIG. 1: a tooth 7 of the disc has a width of 8 mm, with 40 teeth, and a gap $\delta$ of 0.5 mm between the disc 3 and the teeth 7, and glue was prepared at a circumferential speed of 12.4 m/sec along the outermost circumference of the blade 2*a*. Preparation of carrier glue was completed in ten minutes, and dilution and addition of secondary starch were completed in another three minutes. Fine powder produced immediately after the addition of secondary starch was dispersed in three minutes. Borax was then added immediately, and the mixture was agitated for six minutes to complete glue preparation. The product glue had a viscosity as represented by Stein-Hall seconds of 47 sec, and a Brookfield viscosity of 309 cps. The glue obtained was transferred by a pump 9 through a valve 8 shown in FIG. 2 into a storage tank.

EXAMPLE 2

Now, another case of glue preparation with double-volume water by the no-carrier method under the same conditions as above will be described.

Starch was charged into hot water, and after agitation for five minutes, caustic soda was added. After the lapse of 27 minutes, boric acid was added, then the mixture was agitated for a further ten minutes to complete glue preparation. The product glue had a viscosity as represented by Stein-Hall seconds of 92 sec and a Brookfield viscosity of 789 cps. Using this manner of glue preparation, the product viscosity can be reduced by shortening the time before addition of boric acid to about 15 minutes.

EXAMPLE 3

Figure 12:
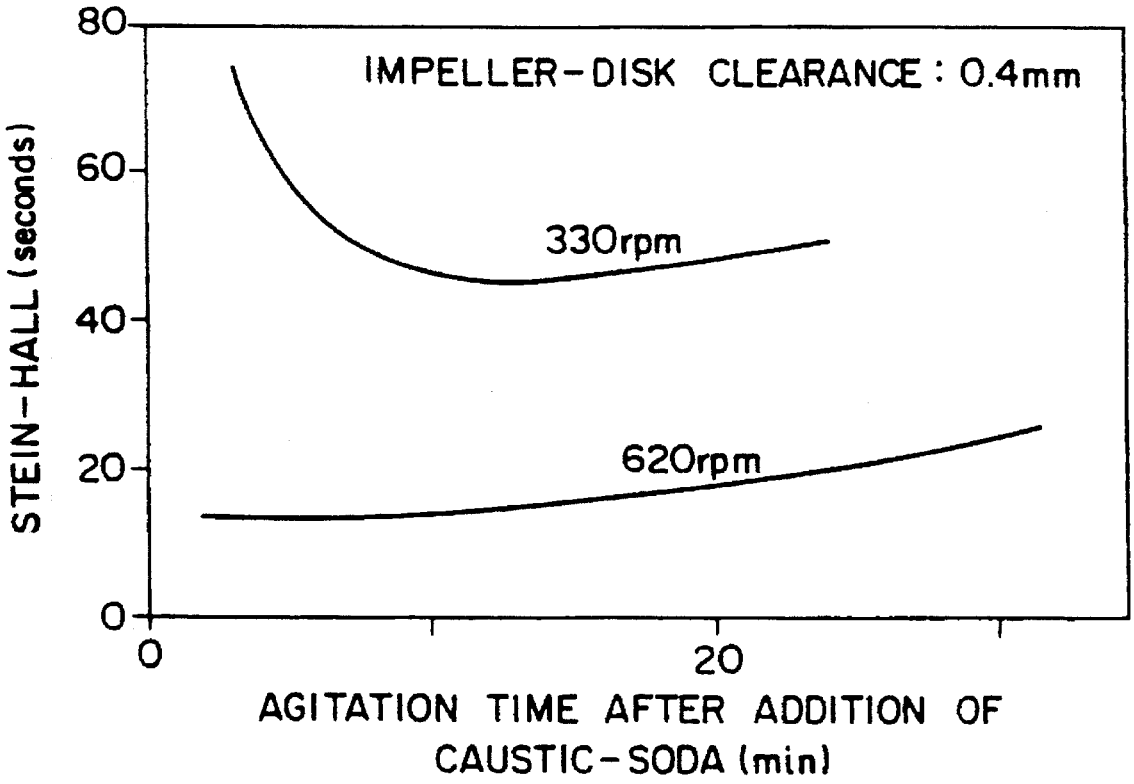
FIG. 12 shows a diagram illustrating an example of the relationship between the agitation time after completion of addition of caustic soda and Stein-Hall seconds in the present invention.

Glue preparation at agitator revolutions different from the above by the no-carrier method is illustrated in FIG. 12. The curve shown in FIG. 12 represents the relationship between the agitation time from the completion of addition of caustic soda up to immediately before the addition of boric acid and Stein-Hall seconds. Comparison of 620 rpm and 330 rpm reveals that the former corresponds to a lower absolute value of viscosity and a lower viscosity increase. This means that, by altering the speed of the agitator in the middle of glue preparation, it is possible to freely change the viscosity of the starchy slurry.

Figure 13:
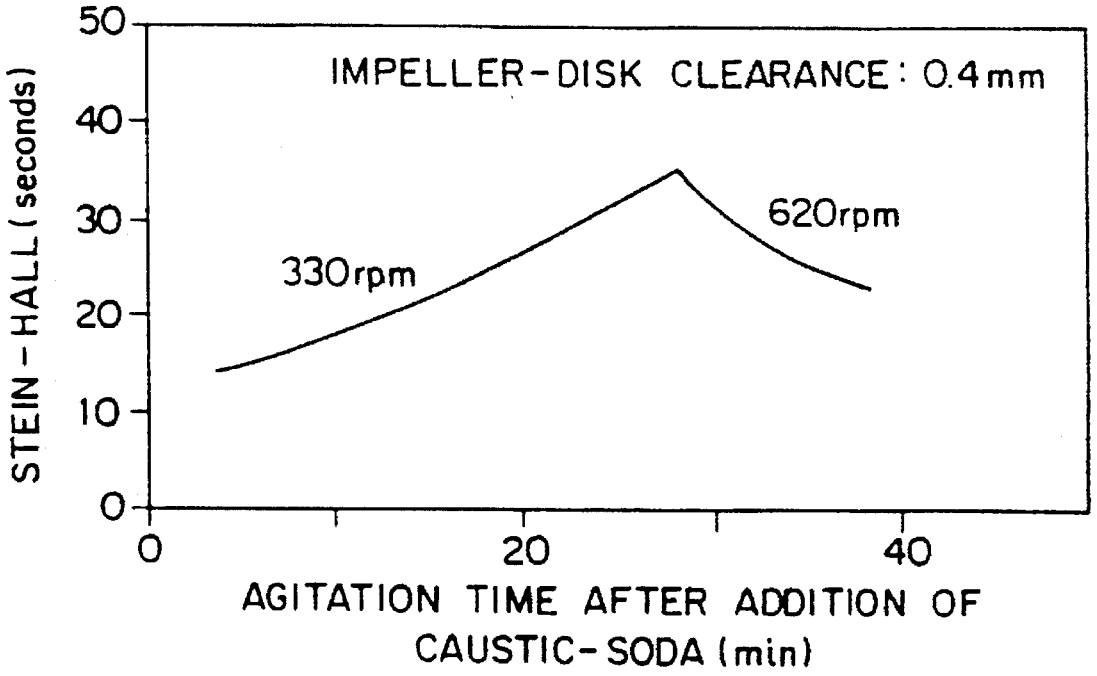
FIG. 13 shows a diagram illustrating the relationship between the agitation time after completion of addition of caustic soda and Stein-Hall seconds in a case different from that shown in FIG. 12.

FIG. 13 proves the above-mentioned effect: the viscosity is reduced by increasing the agitation speed from 330 rpm to 620 rpm. The curves for 330 rpm are different between FIGS. 12 and 13 because the mixture was agitated at 330 rpm from the beginning in FIG. 12, whereas the mixture was agitated at 620 rpm until completion of the addition of caustic soda, and then the speed was reduced to 330 rpm.

Figure 14:
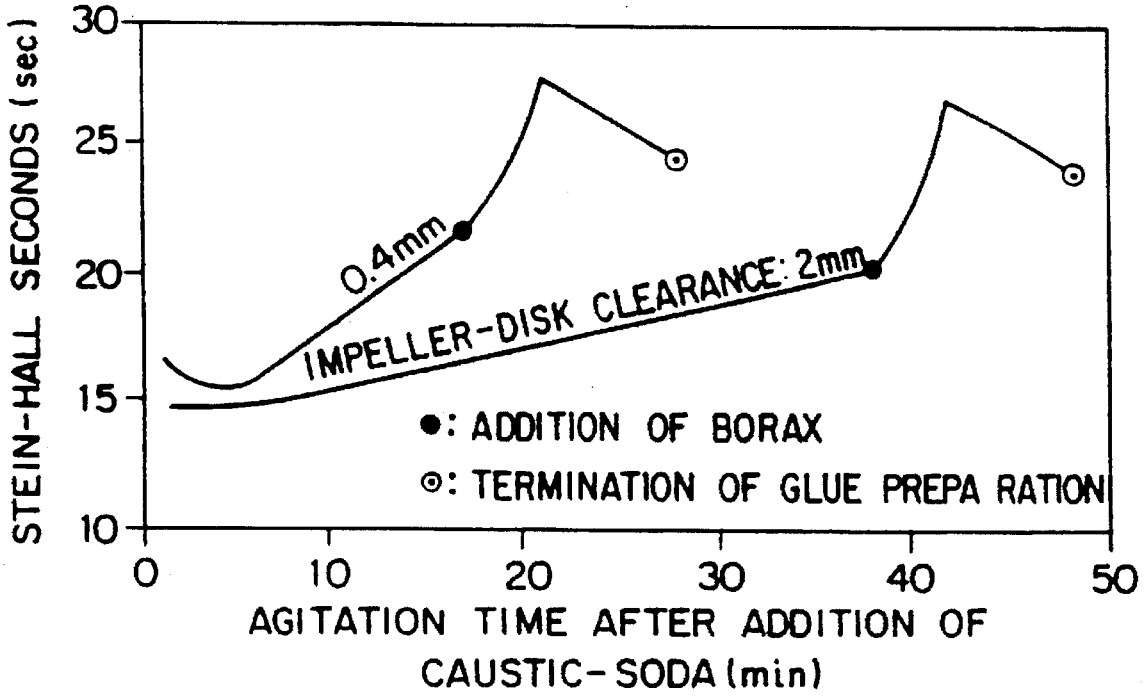
FIG. 14 shows a diagram illustrating an example of the relationship between the agitation time from completion of addition of caustic soda up to completion of glue preparation and Stein-Hall seconds in the present invention.
Figure 15:
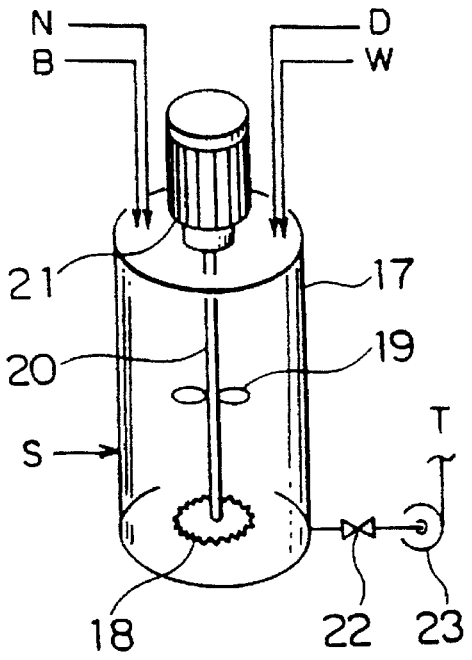
PRIOR ART FIG. 15
FIG. 15 shows a perspective view illustrating an example of the conventional glue preparing equipment main tank.
Figure 16:
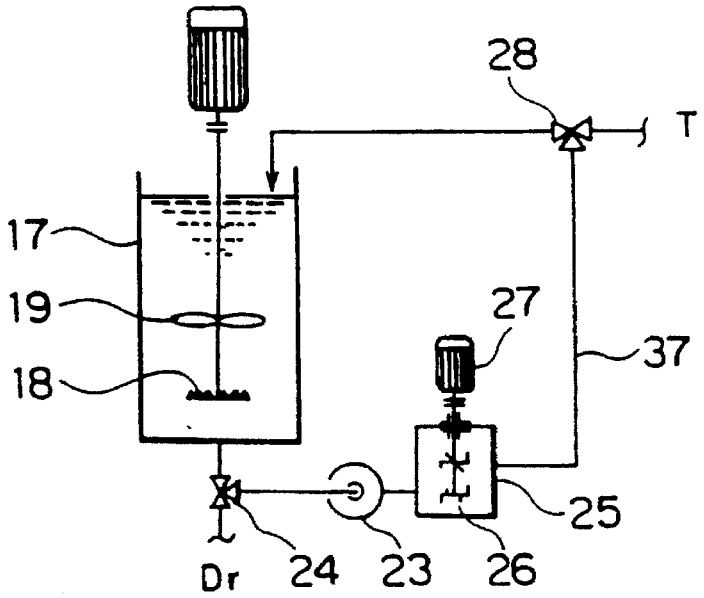
PRIOR ART FIG. 16
FIG. 16 shows a system diagram illustrating a conventional glue preparing main tank used for the Stein-Hall method.
Figure 17:
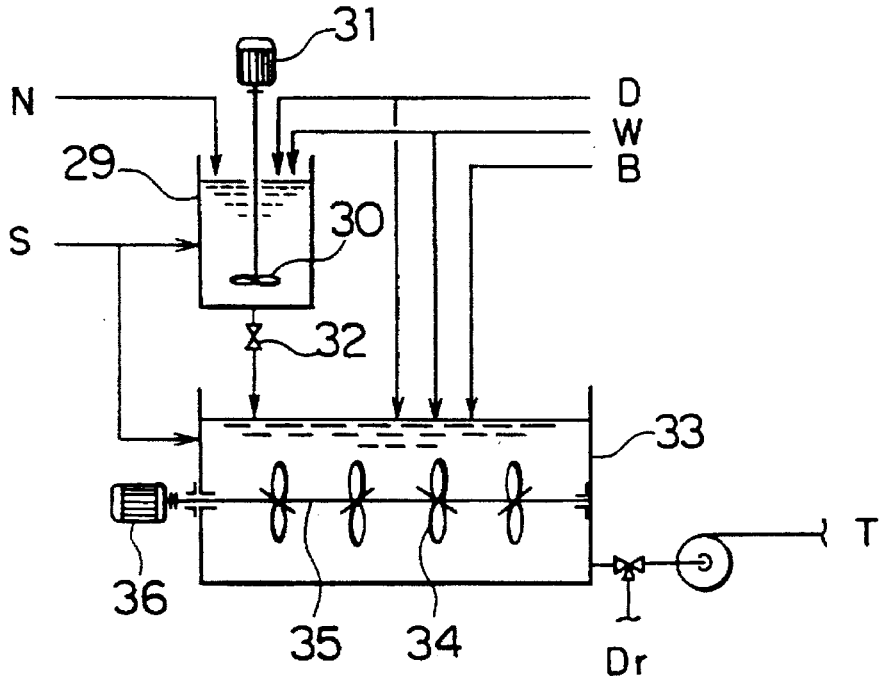
PRIOR ART FIG. 17
FIG. 17 shows a system diagram illustrating a conventional two-tank type glue preparing equipment based on the Stein-Hall method different from that shown in FIG. 16.
Figure 18:
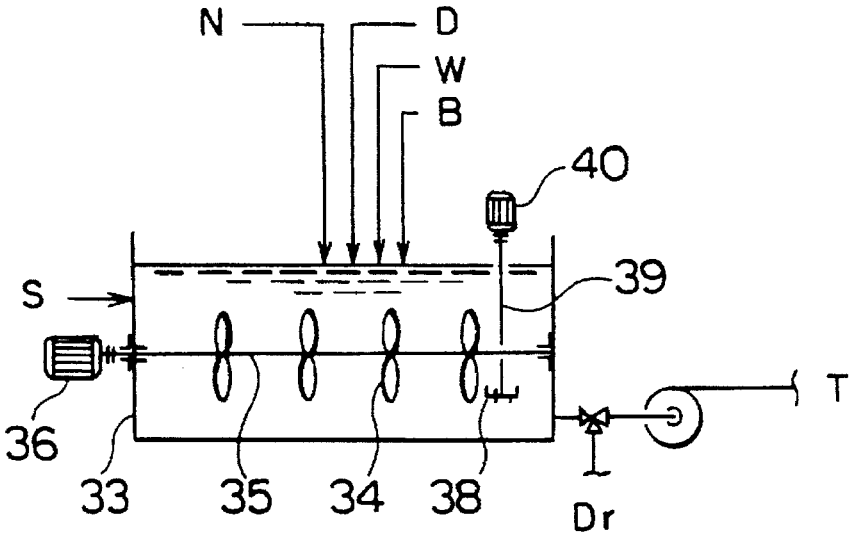
PRIOR ART FIG. 18
FIG. 18 shows a system diagram illustrating a conventional glue preparing main tank based on the no-carrier method.

FIG. 14 shows curves representing changes in Stein-Hall seconds during glue preparation for gaps δ of 0.4 mm and 2 mm between the lower surface of the agitating blade 2*a* of the agitating unit and the upper surface of the teeth of the disc 3. An increased gap δ helps to alleviate the increase in viscosity even at a constant agitating speed, suggesting that it is possible to increase the amount of swelled starch by increasing the agitation time while inhibiting the increase in viscosity.

According to the present invention, as described above in detail, the main tank of the present invention, which gives an agitating effect far larger than the conventional ones due to the effect of a larger-diameter agitating blade and baffles and produces a remarkable shearing effect due to the use of the agitating unit, is applicable to the Stein-Hall method, the no-carrier method and the Mino-Carr method, which are typical methods for preparing glue for corrugated cardboard. Particularly in the Stein-Hall method, while the conventional main tank requires installation of an external high-speed shear or a separate tank for preparing carrier glue, the main tank of the present invention permits glue preparation with a single main tank alone.

A single agitator conducts agitation and shearing, and the effective shear accomplished by the blade and the disc saves energy compared with the conventional ones: power consumption per m3 of slurry is 1 for the Stein-Hall method and also 1 for the no-carrier method in the present invention, whereas it is 1.3 for the Stein-Hall method and 1.5 to 2 for the no-carrier method in the conventional practices.

When preparing glue by the no-carrier method or the Mino-Carr method, while the conventional main tank permits preparation of glue of a concentration of only about triple-volume water, the main tank of the present invention permits preparation of glue of double-volume water. Since the water content of glue is low as described above, the drying required is less, thus making it possible to increase the speed of a corrugated cardboard manufacturing equipment.

Along with the tendency toward a higher speed of the corrugated cardboard manufacturing equipment, a high glue viscosity requires that more glue adheres to the core sheet than is needed. In the present invention, it is possible to prepare glue of a low viscosity capable of coping with the tendency toward higher speeds of the corrugated cardboard manufacturing equipment due to the effects of strong agitation and high shearing, which were conventionally unavailable.

Even by preparing glue with constant blending of raw materials and constant agitating time, the viscosity of the product glue varies between batches. While the conventional main tank cannot cope with this, it is possible in the main tank of the present invention to control viscosity by altering the revolutions of the agitator during glue preparation, and thus to adjust the viscosity to a uniform value. That is, the product viscosity can be quality controlled.

Furthermore, by interlocking the output from the inline viscosity sensor attached to the tank with the reducer for the motor of the agitator, it is possible to automatically adjust the viscosity.

In addition, by producing a vortex at the tank center by a bell mouth provided on the upper surface of the agitator to selectively suck light-weight undispersed starch for shearing and milling in the agitating unit, it is possible to prepare more uniform glue. Furthermore, in the present invention, glue products of different agitation time can be prepared even with the same product viscosity by altering the gap between the blade of the agitating unit and the teeth of the disc. Since the amount of swelled starch in the starchy slurry increases with the agitation time, partially crushed into soluble starch, it is possible to prepare glue of a different chemical composition by adjusting the gap between the blade and the disc.

Further variations and modification of the foregoing will be apparent to those skilled in the art and are intended to be encompassed by the claims appended herewith.

What is claimed is:

1. A glue preparing equipment main tank which comprises:

a tank, a shaft rotatable in the tank about an axis, an agitator having multiple blades fixed to the shaft, a disc provided with a plurality of radially projecting teeth on a surface thereof facing and spaced apart from the agitator, a driving mechanism which rotates the shaft, and a viscosity sensor, in electrical communication with the driving mechanism, which transmits an output indicative of viscosity of glue in the tank, wherein the driving mechanism changes the speed of the agitator based on the output of the viscosity sensor, wherein one or more baffles each having a triangular cross-section are provided on a bottom surface and a side surface of the tank, and wherein the triangular baffles have a vertical angle of 45° in an upstream direction and at least 75° in a downstream direction.

2. A glue preparing equipment main tank as claimed in claim 1, wherein the tank has a bottom, wherein the shaft is supported to allow rotation of the agitator over the tank bottom, and wherein the disc is attached to the tank bottom.

3. A glue preparing equipment main tank as claimed in claim 1, wherein the shaft is supported to allow rotation of the agitator over a side wall of the tank, and the disc is attached to the tank side wall.

4. A glue preparing equipment main tank as claimed in claim 1, wherein a surface of the agitator facing the disc is formed into a flat shape.

5. A glue preparing equipment main tank as claimed in claim 1, wherein a plurality of teeth are formed on a surface of the agitator facing the disc at an angle crossing the plurality of teeth of the disc.

6. A glue preparing equipment main tank as claimed in claim 1, wherein the distance between the agitator and the disc is adjustable.

7. A glue preparing equipment main tank as claimed in claim 1, wherein a bell mouth is attached to said disc.

8. A method of preparing glue in a glue preparing equipment main tank, which method comprises the steps of:

providing a tank;

providing a shaft rotatable in the tank about an axis;

providing an agitator, having multiple blades, fixed to the shaft;

providing a disc with a plurality of radially projecting teeth on a surface thereof facing and spaced apart from the agitator;

providing a driving mechanism which rotates the shaft in the tank;

providing a viscosity sensor which transmits an output to the driving mechanism indicative of viscosity of glue in the tank; and controlling the viscosity of the glue by driving the driving mechanism to change the speed of the agitator based on the output of the viscosity sensor;

said glue having a value of at least 250 (–/sec·$m^2$) calculated by the equation of ((number of teeth of said disc)×(tooth length (mm))×(number of blades)×(revolutions (rps)))/(slurry volume ($m^3$)).

9. A glue preparing equipment main tank which comprises:

a tank;

a shaft rotatable in the tank about an axis;

an agitator, having multiple blades, fixed to the shaft;

a disc provided with a plurality of radially projecting teeth on a surface thereof facing and spaced apart from the agitator; and a driving mechanism which rotates the shaft in the tank;

wherein the driving mechanism changes the speed of the agitator based on a manual viscosity measurement;

wherein one or more baffles each having a triangular cross-section are provided on a bottom surface and a side surface of the tank; and wherein the triangular baffles have a vertical angle of 45° in an upstream direction and at least 75° in a downstream direction.

10. A method of preparing glue in a glue preparing equipment main tank, which method comprises the steps of:

providing a tank;

providing a shaft rotatable in the tank about an axis;

providing an agitator, having multiple blades, fixed to the shaft;

providing a disc with a plurality of radially projecting teeth on a surface thereof facing and spaced apart from the agitator;

providing a driving mechanism which rotates the shaft in the tank;

providing a viscosity sensor which transmits an output to the driving mechanism indicative of viscosity of glue in the tank; and controlling the viscosity of the glue by driving the driving mechanism to change the speed of the agitator based on the output of the viscosity sensor;

which method further comprises the step of preparing glue with a value of at least 250 (–/sec·$m^2$) calculated by the equation of ((number of teeth of said disc)×(tooth length (mm))×(number of blades)×revolutions (rps)))/(slurry volume ($m^3$)).

11. A method of preparing glue in a glue preparing equipment main tank, which method comprises the steps of:

providing a tank;

providing a shaft rotatable in the tank about an axis;

providing an agitator, having multiple blades, fixed to the shaft;

providing a disc provided with a plurality of radially projecting teeth on a surface thereof facing and spaced apart from the agitator;

providing a driving mechanism which rotates the shaft in the tank;

manually measuring viscosity of glue in the tank; and controlling the viscosity of the glue by variably driving the driving mechanism to change the speed of the agitator based on the manual viscosity measurement.

12. The method as claimed in claim 11, which further comprises the step of preparing glue with a value of at least 250 (–/sec·$m^2$) calculated by the equation of ((number of teeth of said disc)×(tooth length (mm))×(number of blades)×revolutions (rps)))/slurry volume ($m^3$)).

13. Glue, prepared according to the method of claim 11, having a value of at least 250 (–/sec·$m^2$) calculated by the equation of ((number of teeth of said disc)×(tooth length (mm))×(number of blades)×(revolutions (rps)))/slurry volume ($m^3$)).

* * * * *